US006659583B2

(12) United States Patent
Fujimori

(10) Patent No.: US 6,659,583 B2
(45) Date of Patent: Dec. 9, 2003

(54) PRINTING INVOLVING HALFTONE REPRODUCTION WITH DIFFERENT DENSITY INKS IN PIXEL BLOCK UNITS

(75) Inventor: Yukimitsu Fujimori, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 31 days.

(21) Appl. No.: 10/113,012

(22) Filed: Mar. 28, 2002

(65) Prior Publication Data

US 2002/0167560 A1 Nov. 14, 2002

(30) Foreign Application Priority Data

Mar. 30, 2001 (JP) ..... 2001-098219

(51) Int. Cl.[7] ..... B41J 2/205; B41J 2/21
(52) U.S. Cl. ..... 347/15; 347/43
(58) Field of Search ..... 347/43, 15

(56) References Cited

U.S. PATENT DOCUMENTS 5,777,641 A * 7/1998 Suzuki et al. ..... 347/15
6,113,210 A * 9/2000 Gotoh et al. ..... 347/15

FOREIGN PATENT DOCUMENTS

JP 60-084071 5/1985
JP 09-286125 11/1997

OTHER PUBLICATIONS

Abstract of Japanese Patent Pub. No. 60–084071, Pub. Date: May 13, 1985, Patent Abstracts of Japan.

Abstract of Japanese Patent Pub. No. 09–286125, Pub. Date: Nov. 4, 1997, Patent Abstracts of Japan.

* cited by examiner

*Primary Examiner*—Thinh Nguyen
(74) *Attorney, Agent, or Firm*—Martine & Penilla, LLP

(57) ABSTRACT

A print area is divided into pixel blocks, each consisting of a plurality of pixels. Tone reproduction is performed with different density inks for cyan and magenta by a method in which the pixels in each pixel block are correlated on a one-on-one basis with the ejection positions of a plurality of different density inks, and different density dots are formed at each pixel position. Large dots extending across a plurality of pixels are formed with yellow and black inks.

14 Claims, 19 Drawing Sheets

ARRANGEMENT OF DARK AND LIGHT DOTS (cyan and magenta)

ARRANGEMENT OF NORMAL-DENSITY LARGE DOTS (yellow and black)

*Fig.5*

RELATIVE COLORANT DENSITIES OF INKS
(first embodiment)

| | DC | LC | DM | LM | Y | K |
|---|---|---|---|---|---|---|
| CYAN COLORANT | 1.5 | 0.5 | | | | |
| MAGENTA COLORANT | | | 1.5 | 0.5 | | |
| YELLOW COLORANT | | | | | 1 | |
| BLACK COLORANT | | | | | | 1 |

P1
P2
P3
P4

COMMON DRIVE SIGNAL
COMa (pass 1)
W1
W1
LD
360dpi
LD

LIGHT DOT FORMATION
(pass 1)

COMMON DRIVE SIGNAL
COMb (pass 1)
W1
W1
DD
DD

DARK DOT FORMATION
(pass 1)
LD
DD
LD
DD

DARK AND LIGHT DOT
FORMATION (pass 1)

COMMON DRIVE SIGNAL
COMc (pass 1)

NORMAL-DENSITY
LARGE DOT FORMATION
(pass 1)

ARRANGEMENT OF DARK AND LIGHT DOTS (cyan and magenta)

ARRANGEMENT OF NORMAL-DENSITY LARGE DOTS (yellow and black)

D(L-on): DENSITY LEVEL WHEN LIGHT DOTS ARE "ON"

*Fig. 13*

RELATIVE COLORANT DENSITIES OF INKS
(second embodiment)

| | C | LC | M | LM | Y | K |
|---|---|---|---|---|---|---|
| CYAN COLORANT | 1 | 0.25 | | | | |
| MAGENTA COLORANT | | | 1 | 0.25 | | |
| YELLOW COLORANT | | | | | 1 | |
| BLACK COLORANT | | | | | | 1 |

P1
P2
P3
P4

COMMON DRIVE SIGNAL COMa (pass 1)
W1a
W1a
LDa
360dpi
LDa

LIGHT DOT FORMATION (pass 1)

COMMON DRIVE SIGNAL COMb (pass 1)
W1a
W1a
NDa
NDa

NORMAL-DENSITY DOT FORMATION (pass 1)
LDa
NDa
LDa
NDa

TOTAL DOT FORMATION (pass 1)

*Fig. 16*

RELATIVE COLORANT DENSITIES OF INKS
(third embodiment)

| | DC | NC | LC | DM | NM | LM | Y | K |
|---|---|---|---|---|---|---|---|---|
| CYAN COLORANT | 1.5 | 1 | 0.5 | | | | | |
| MAGENTA COLORANT | | | | 1.5 | 1 | 0.5 | | |
| YELLOW COLORANT | | | | | | | 1 | |
| BLACK COLORANT | | | | | | | | 1 |

P1
P2
P3
P4
P5

COMMON DRIVE SIGNAL COMa (pass 1)
W1
W1

LIGHT DOT FORMATION (pass 1)
LD
360dpi
LD

COMMON DRIVE SIGNAL COMb (pass 1)
W1
W1

NORMAL-DENSITY DOT FORMATION (pass 1)
ND
ND

COMMON DRIVE SIGNAL COMc (pass 1)
W1

DARK DOT FORMATION (pass 1)
DD

TOTAL DOT FORMATION (pass 1)
LD
ND
DD
LD
ND

ARRANGEMENT OF DIFFERENT DENSITY DOTS
(cyan and magenta)

ARRANGEMENT OF NORMAL-DENSITY LARGE DOTS
(yellow and black)

PRINTING INVOLVING HALFTONE REPRODUCTION WITH DIFFERENT DENSITY INKS IN PIXEL BLOCK UNITS

BACKGROUND OF THE INVENTION

1. Field of the Invention

The present invention relates to a technique for printing images by ejecting ink drops.

2. Description of the Related Art

Ink-jet printers are widely used as computer output devices. Most of the ink-jet printers are color printers capable of printing in color.

A color printer needs to have good image quality and a high printing speed. The image quality of printed color images can be dramatically improved by the use of light cyan and magenta inks. Printing can be speeded up by increasing the number of nozzles for each ink. It is, however, necessary to increase the number of nozzles for all the inks in order to accelerate printing when images are printed in color, so it is sometimes difficult to accelerate printing in this manner.

SUMMARY OF THE INVENTION

An object of the present invention is to provide a technique for improving printing speed during color printing.

In order to attain at least part of the above and other related objects of the present invention, there is provided a printing device for printing images on a printing medium during main scanning. The printing device comprises: a print head having a plurality of nozzle arrays for ejecting multiple types of ink, and a plurality of ejection drive elements for causing ink drops to be ejected from nozzles of the plurality of nozzle arrays. The printing device further comprises: a main scan drive unit for performing main scans by causing the printing medium and/or the print head to move; a sub-scan drive unit for performing sub-scans by causing the printing medium and/or the print head to move; a head drive unit for sending drive signals to the ejection drive elements in accordance with given print signals; and a control unit for controlling each of the above units. The print head comprises N nozzle arrays for ejecting N types of identically hued inks, respectively, for at least for one hue, where N is an integer of 2 or greater. The identically hued inks are inks that have substantially a same hue but mutually different densities. The control unit has a specific print mode in which tone reproduction using the N types of identically hued inks is performed such that (i) a print area is divided into pixel blocks each consisting of N pixels, and (ii) the N pixels in each pixel block are assigned to ejection positions of the N types of identically hued inks, respectively.

The print head may have N nozzle arrays for ejecting the N types of identically hued inks for cyan and magenta. The control unit may operate in the specific print mode such that (iii) tone reproduction for cyan and magenta is performed using the N types of identically hued inks in each pixel block for each of the cyan and magenta; and (iv) tone reproduction for at least one of yellow and gray is performed by forming large dots of corresponding ink across a plurality of pixels.

The present invention can be implemented in various embodiments, such as a printing method and a printing device, a print control method and a print control device, a computer program for implementing the functions of these methods or devices, a recording medium having the computer program recorded thereon, and data signals embodied in a carrier wave containing the computer program.

These and other objects, features, aspects, and advantages of the present invention will become more apparent from the following detailed description of the preferred embodiments with the accompanying drawings.

BRIEF DESCRIPTION OF THE DRAWINGS

FIG. 5 is a diagram illustrating the relative colorant densities of the inks used in the first embodiment;

FIG. 13 is a diagram depicting the relative colorant densities of inks used in accordance with the second embodiment;

FIG. 16 is a diagram depicting the relative colorant densities of inks used in accordance with the third embodiment;

DESCRIPTION OF THE PREFERRED EMBODIMENT

A. Apparatus Structure

Figure 1:
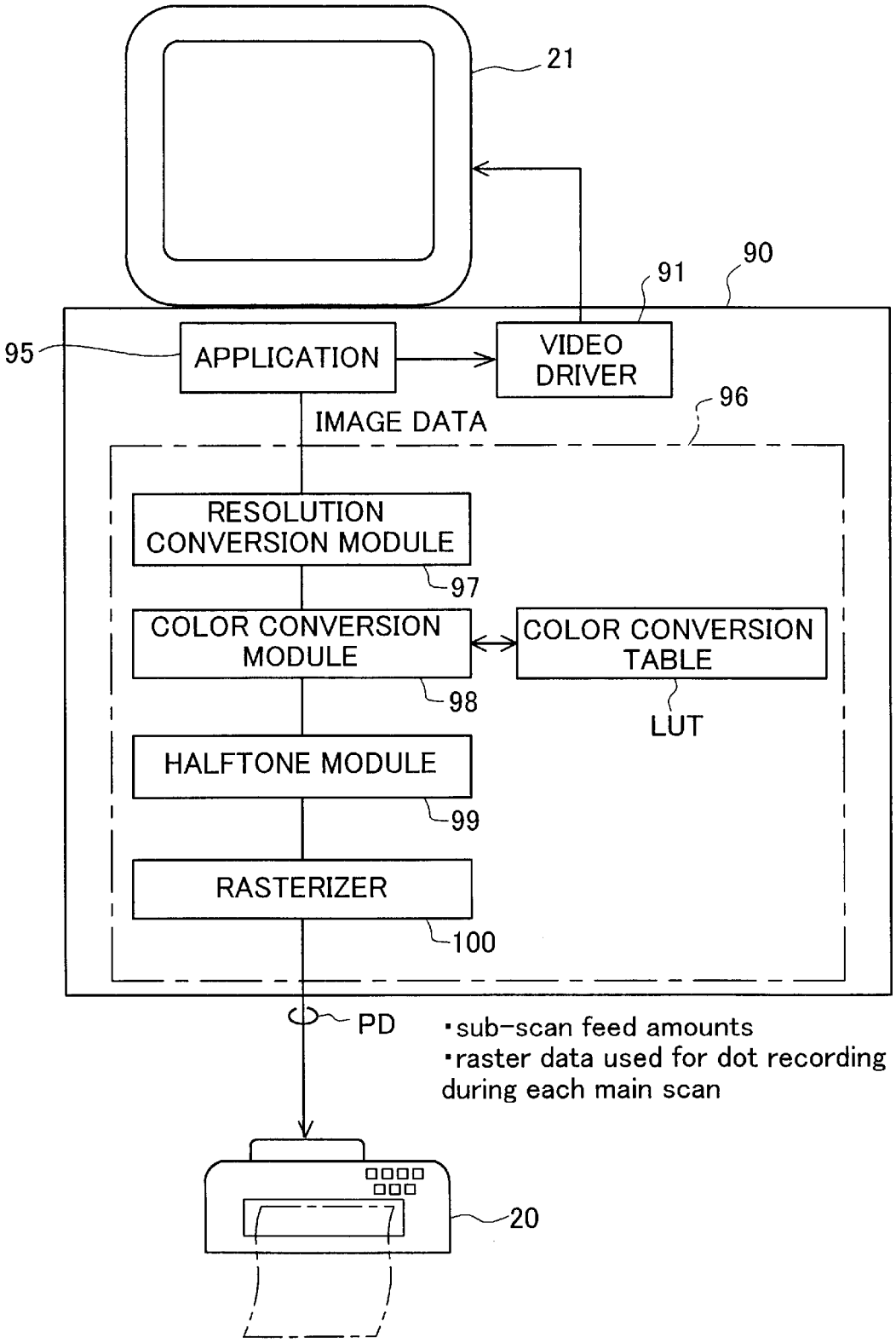
FIG. 1 is a block diagram depicting the structure of a printing system embodying the present invention.

FIG. 1 is a block diagram depicting the structure of a printing system embodying the present invention. The printing system comprises a computer 90, and a color printer 20. A combination of the color printer 20 and computer 90 can be interpreted as a printing apparatus.

In the computer 90, an application program 95 is executed by a specific operating system. The operating system contains a video driver 91 and a printer driver 96. The application program 95 outputs the print data PD to the color printer 20 via the printer driver. The application program 95 processes designated images in the desired manner and displays the images on a CRT 21 with the aid of the video driver 91.

When the application program 95 issues a print command, the printer driver 96 of the computer 90 receives image data from the application program 95 and converts these data to the print data PD to be supplied to the color printer 20. In the example shown in FIG. 1, the printer driver 96 contains a resolution conversion module 97, a color conversion module 98, a halftone module 99, a rasterizer 100, and a color conversion table LUT.

The role of the resolution conversion module 97 is to convert the resolution of the color image data handled by the application program 95 (that is, the number of pixels per unit length) into a resolution that can be handled by the printer driver 96. The image data converted in terms of resolution in this manner are still in the form of image information composed of three colors (RGB). The color correction module 98 converts the RGB data in individual pixels into multi-tone data for a plurality of ink colors and usable by the color printer 20 while the color correction table LUT is consulted.

The color-corrected multi-tone data may, for example, have 256 tone levels. The halftone module 99 executes a halftoning routine to produce halftone image data. The halftone image data are rearranged by the rasterizer 100 according to a sequence in which the data are sent to the color printer 20, and are outputted as final print data PD. The print data PD comprise raster data for specifying dot formation during main scanning, and data for specifying sub-scan feed amounts.

The printer driver 96 is a program for performing functions whereby print data PD are generated. The program for performing the functions of the printer driver 96 can be stored on a computer-readable storage medium. Examples of such storage media include floppy disks, CD-ROMs, magnetooptical disks, IC cards, ROM cartridges, punch cards, printed matter with bar codes and other printed symbols, internal computer storage devices (RAM, ROM, and other types of memory), external storage devices, and various other computer-readable media.

The computer 90 provided with the printer driver 96 functions as a print control device for producing print data PD and causing the printer 20 to perform printing according to the print data PD.

Figure 2:
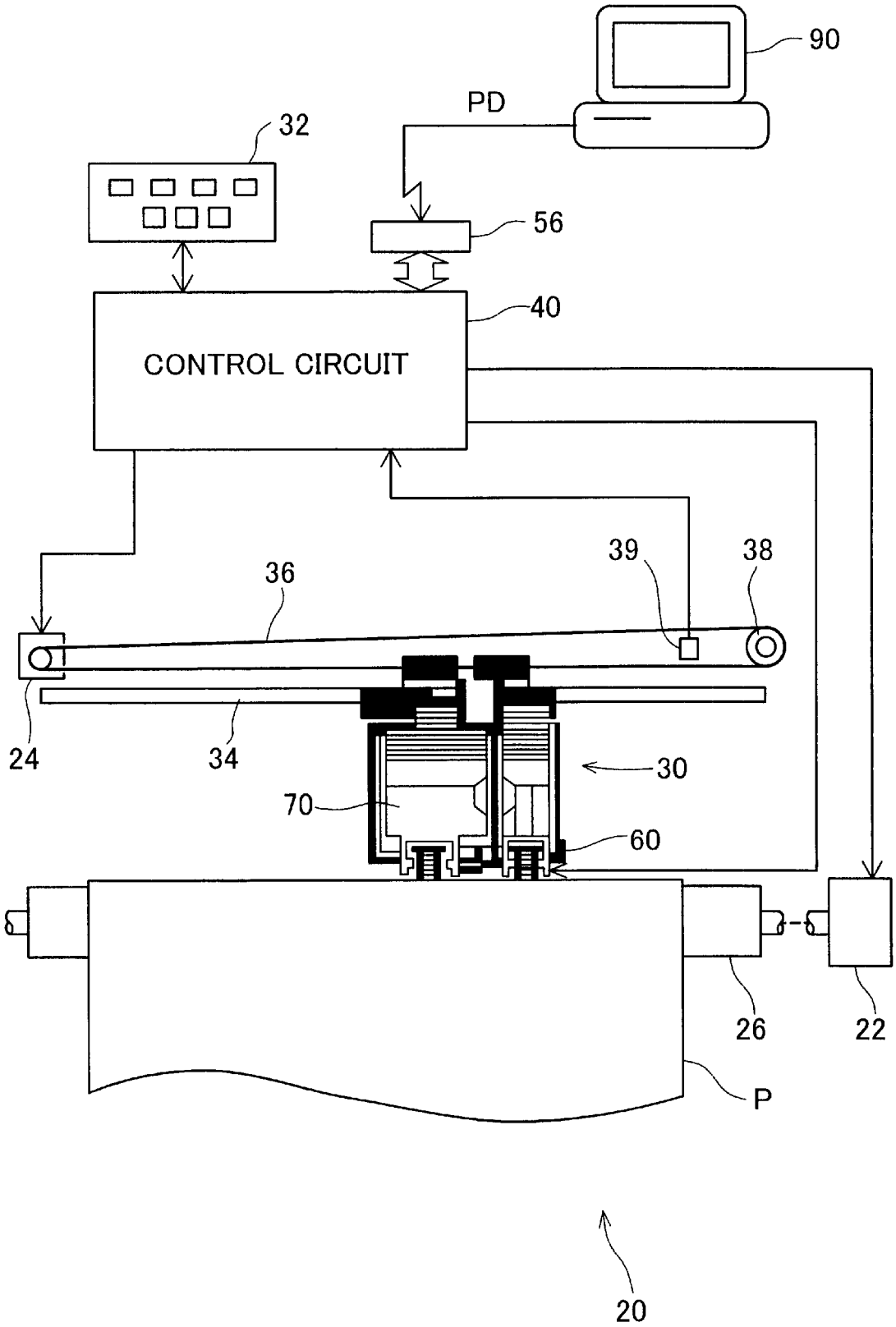
FIG. 2 is a diagram illustrating the printer structure.

FIG. 2 is a schematic structural drawing of the color printer 20. The color printer 20 comprises a sub-scanning mechanism for transporting printing paper P in the direction of sub-scanning with the aid of a paper feed motor 22; a main scanning mechanism for reciprocating a carriage 30 in the axial direction (direction of main scanning) of a platen 26 with the aid of a carriage motor 24; a head drive mechanism for actuating a print head unit 60 (also referred to as a "print head assembly") mounted on the carriage 30 and controlling ink ejection and dot formation; and a control circuit 40 for exchanging signals between the paper feed motor 22, the carriage motor 24, the print head unit 60, and a control panel 32. The control circuit 40 is connected to the computer 90 by a connector 56.

The sub-scanning mechanism for transporting the printing paper P is provided with a gear train (not shown) for transmitting the rotation of the paper feed motor 22 to the platen 26 and a paper feed roller (not shown). The main scanning mechanism for reciprocating the carriage 30 comprises a sliding shaft 34 mounted parallel to the axis of the platen 26 and designed to slidably support the carriage 30, a pulley 38 for extending an endless drive belt 36 from the carriage motor 24, and a position sensor 39 for sensing the original position of the carriage 30.

Figure 3:
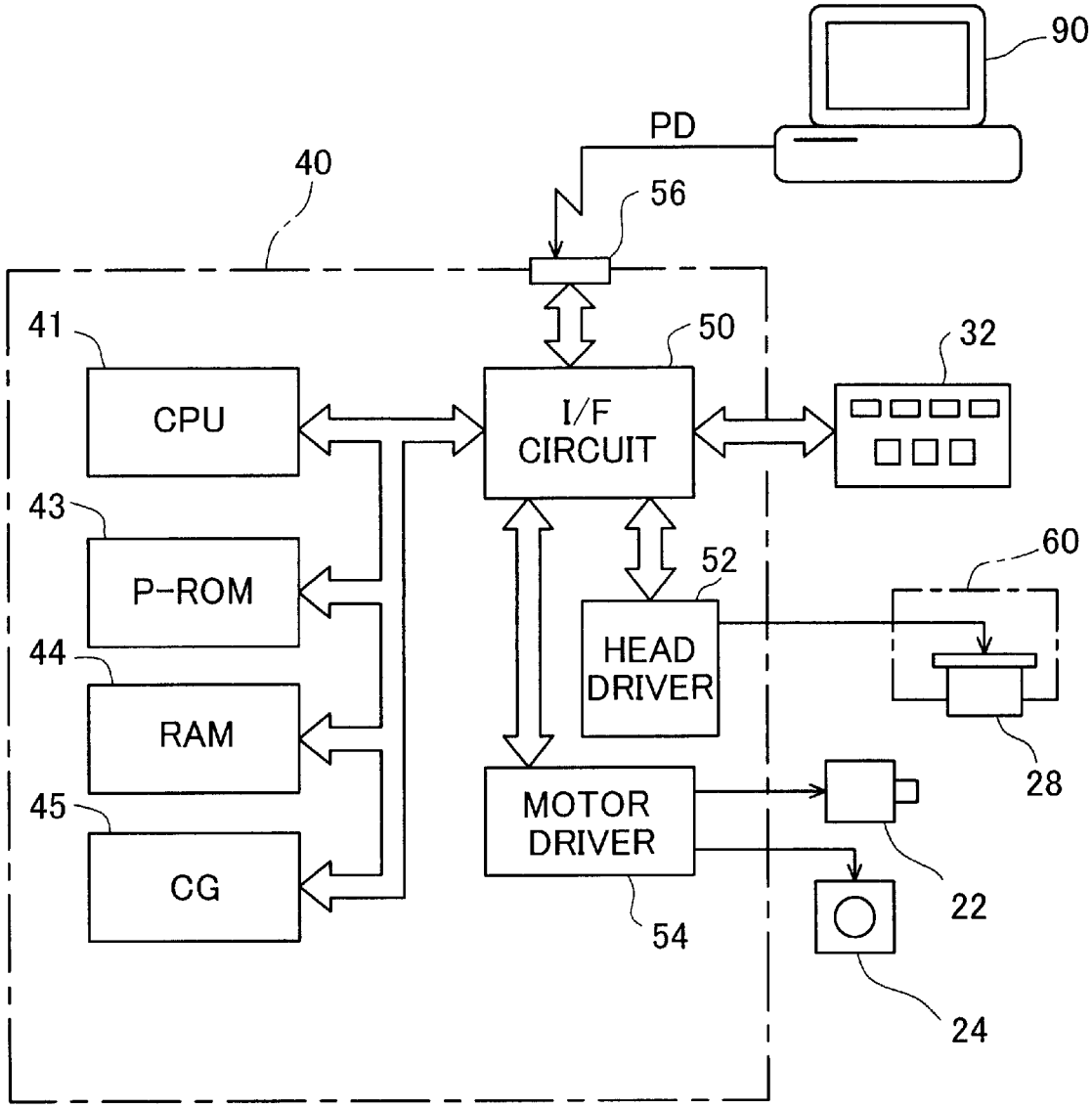
FIG. 3 is a block diagram depicting the structure of the control circuit 40 in the printer 20.

FIG. 3 is a block diagram depicting the structure of a color printer 20 based on the control circuit 40. The control circuit 40 comprises a CPU 41, a programmable ROM (PROM) 43, a RAM 44, and a character generator (CG) 45 containing dot matrices for characters. The control circuit 40 further comprises an I/F circuit 50 for interface with external motors and the like, a head drive circuit 52 connected to the I/F circuit 50 and designed to eject ink by actuating the print head unit 60, and a motor drive circuit 54 for actuating the paper feed motor 22 and carriage motor 24. The I/F circuit 50 contains a parallel interface circuit and is capable of receiving print data PD from the computer 90 via the connector 56. The color printer 20 prints images in accordance with the print data PD. RAM 44 functions as a buffer memory for the temporary storage of raster data.

The CPU 41 functions as a "controller" in a narrow sense for controlling the printing operation. The combination of the CPU 41, PROM 43, RAM 44 in the controlling circuit 40, and the computer 90 as a whole perform various controls of printing operation, so they can be called "controller" in a broad sense.

The print head unit 60 has a print head 28 and is designed for mounting ink cartridges 70 (FIG. 2). The print head unit 60 can be mounted on the color printer 20 and removed there from as a single component. In other words, the print head unit 60 is replaced when the print head 28 needs to be replaced.

B. First Embodiment

Figure 4:
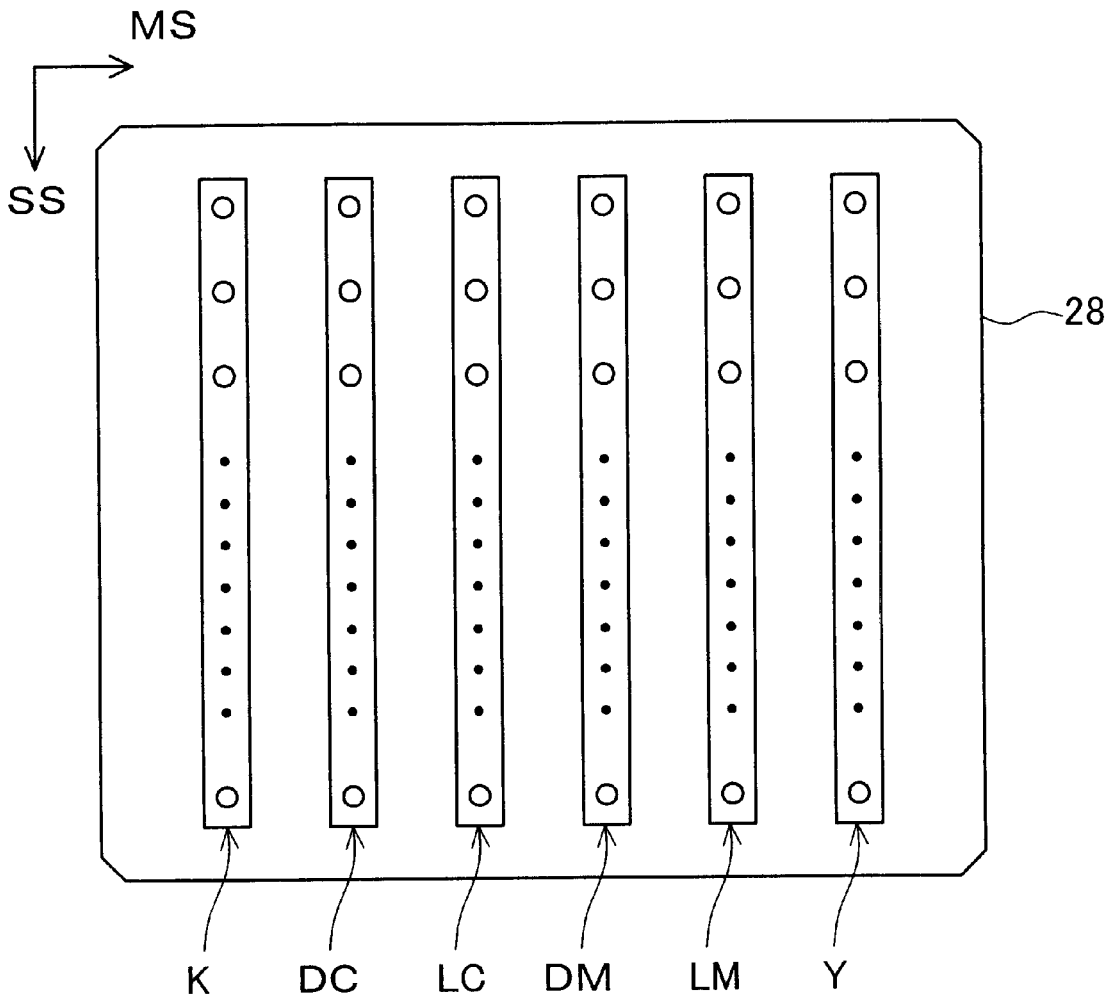
FIG. 4 is a diagram depicting the arrangement of nozzles on the bottom surface of the print head 28 according to a first embodiment.

FIG. 4 is a diagram depicting the arrangement of nozzles on the bottom surface of the print head 28 used in the first embodiment. The print head 28 is provided with nozzle arrays for ejecting black ink K, dark cyan ink DC, light cyan ink LC, dark magenta ink DM, light magenta ink LM, and yellow ink Y, respectively. Each nozzle is provided with a piezo-electric element (not shown) as an ejection drive element.

The six-nozzle arrays are disposed at the same positions in the sub-scanning direction SS. Consequently, the six types of ink are ejected on the same main scan line during a single main scan when ink drops are ejected from the nozzles while the print head 28 is scanned in the main scanning direction MS.

The dark cyan ink DC and light cyan ink LC have substantially the same hue but mutually different colorant densities. The same applies to the dark magenta ink DM and light magenta ink LM. In the present specification, a plurality of inks having substantially the same hue but different densities will be referred to as "different density inks" or "identically hued inks."

FIG. 5 is a diagram depicting the relative colorant densities of the inks used in the first embodiment. It is assumed here that the yellow ink Y and black ink K have a relative colorant density of 1. The dark cyan ink DC and dark magenta ink DM have a relative density of 1.5, and the light cyan ink LC and light magenta ink LM have a relative density of 0.5 The mean relative colorant density of the dark cyan ink DC and light cyan ink LC is 1. The same applies to magenta inks.

A black color (more commonly referred to as a "gray color") substantially identical to the black ink K can be reproduced if solid images are reproduced using equal amounts of cyan, magenta, and yellow inks having a relative density of 1. Inks with a relative density of 1 are commonly used as the three primary color inks CMY. By contrast, the printer 20 used herein differs from a conventional printer in that the dark/light cyan inks have an average colorant density which is equal to the relative density of the yellow colorant of the yellow ink, and so do the dark/light magenta inks.

Figure 6:
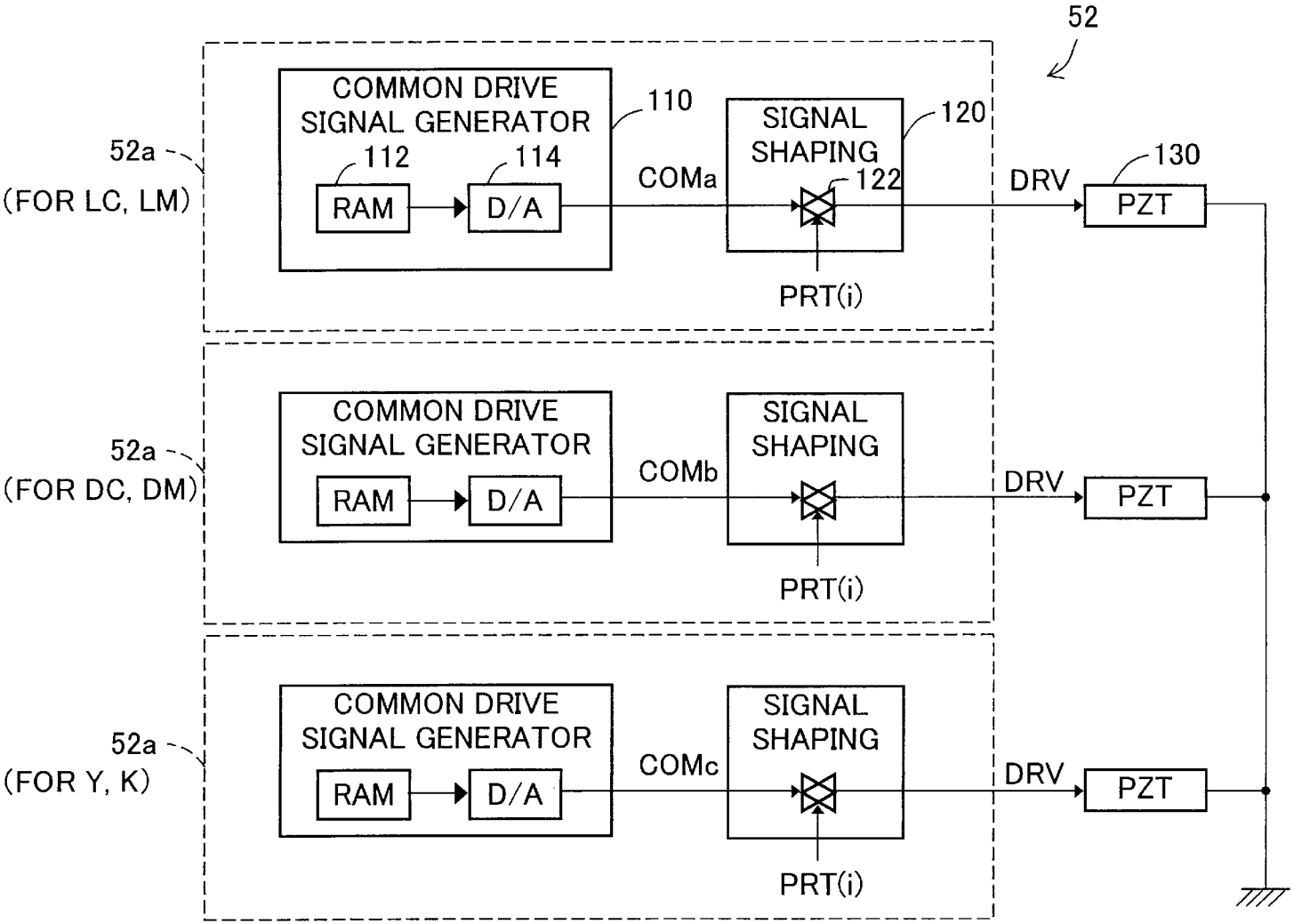
FIG. 6 is a block diagram depicting the internal structure of the head drive circuit 52 (FIG. 2)

FIG. 6 is a block diagram depicting the internal structure of the head drive circuit 52 (FIG. 3) used in the first embodiment. The head drive circuit 52 comprises a first drive circuit 52*a* for the light inks LC and LM, a second drive circuit 52*b* for the dark inks DC and DM, and a third drive circuit 52*c* for the yellow and black inks. The three drive circuits 52*a*–52*c* have the same constituent elements, so the description that follows will be primarily given with reference to the first drive circuit 52*a*.

The first drive circuit 52*a* comprises a common drive signal generating circuit 110 and a drive signal shaping circuit 120. The common drive signal generating circuit 110 comprises a D-A converter 114 and a RAM 112 for storing waveform data that specify the waveform of the common drive signal COMa. A common drive signal COMa having an arbitrary waveform can be generated by subjecting the waveform data stored in the RAM 112 to a D-A conversion.

The drive signal shaping circuit 120 is provided with a plurality of analog switches 122 whereby the common drive signal COMa is completely or partially masked in accordance with the value of a serial print signal PRT, and a drive signal DRV is generated for each nozzle accordingly. The drive signal DRV thus shaped is fed to the piezo-electric element 130 (drive element) of each nozzle. In the example shown in FIG. 6, a single analog switch 122 and a single piezo-electric element 130 are depicted, but in practice the number of analog switches 122 and that of piezo-electric elements 130 are equal to the number of nozzles. The switches 122 are presented with the serial print signal PRT for each nozzle. The serial print signal PRT is obtained by a method in which the raster data contained in the print data PD presented to the printer 20 by the computer 90 (FIG. 1) are converted to a serial signal.

In the present specification, the term "common drive signal" refers to a drive signal shared by a plurality of nozzles. The waveforms and the generation timing of the common drive signals COMa-COMc produced by the three drive circuits 52*a*–52*c* are described below. The waveforms of the common drive signals COMa-COMc can be arbitrary changed by altering the waveform data in the RAM 112. It is also possible to vary the waveform of the common drive signal with each main scan. In the embodiments described below, the dot formation is performed using these functions of the common drive signal generating circuit 110.

FIGS. 7(A)–7(E) are diagrams illustrating dot formation and the waveforms of the drive signals used to eject cyan and magenta inks in a high-speed print mode. Since the ejection of cyan and magenta inks is controlled based on the same principle, the description that follows will be given without any particular distinction between cyan and magenta.

Figures 7A, 7B, 7C, 7D, 7E:
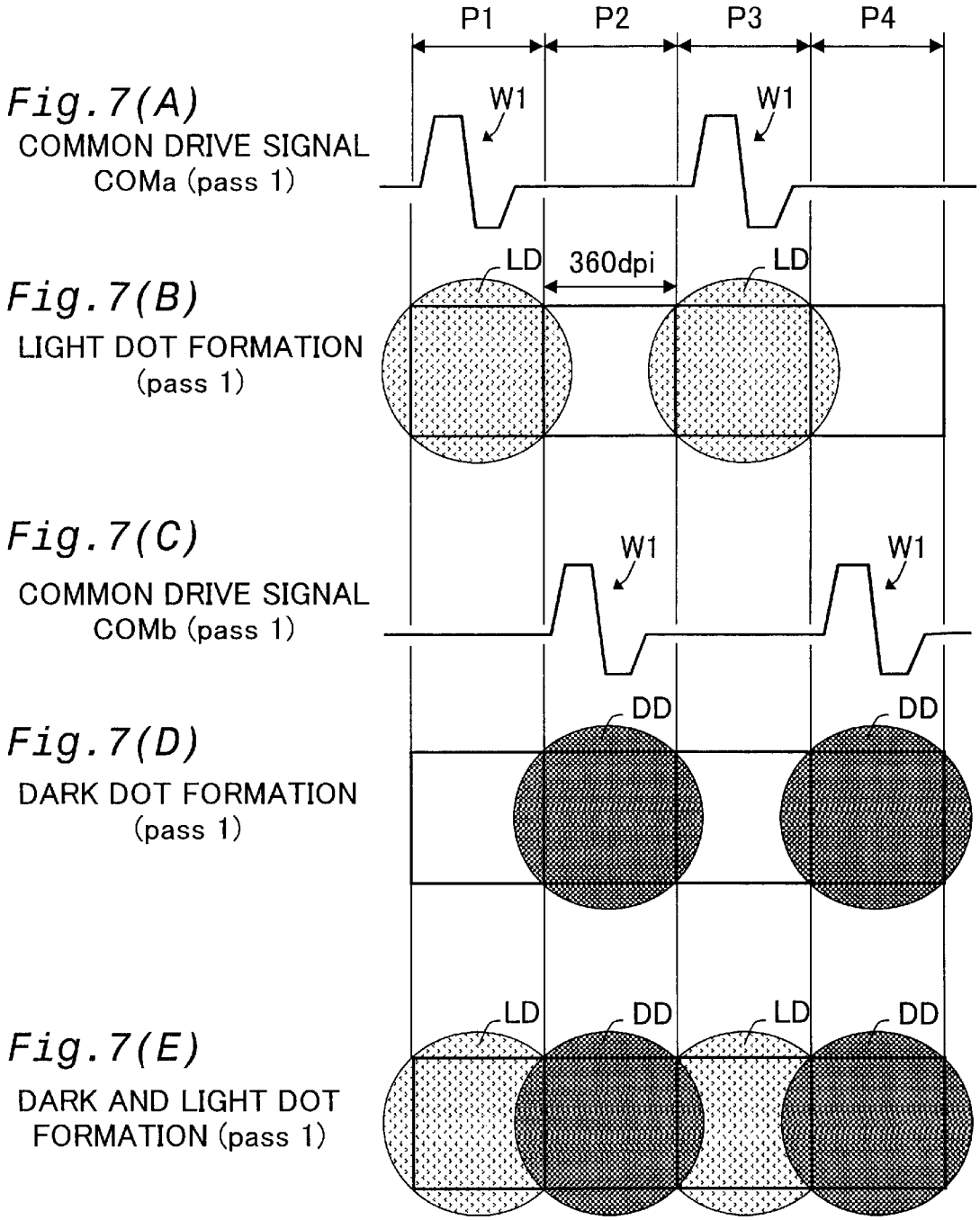
FIGS. 7(A)–7(E) illustrate dot formation and the waveforms of the drive signals used to eject cyan and magenta inks in accordance with the high-speed print mode of the first embodiment.

FIGS. 7(A) and 7(B) depict the formation of light dots LD and the waveform of the first common drive signal COMa for forming the light dots LD. Each of the rectangles in FIG. 7(B) represents a single pixel, and four pixel positions P1–P4 disposed in sequence on a main scan line are depicted herein. In this print mode, the print resolution in the main scanning direction is 360 dpi. The first common drive signal COMa is a signal that generates a single dot-forming pulse W1 for every other pixel. The pulse W1 is applied to the piezo-electric element 130 (FIG. 6) when light dots LD are to be formed, as shown in FIG. 7(B). The pulse W1 is masked by the drive signal shaping circuit 120 (FIG. 5) when no light dots LD are to be formed. In the example shown in FIG. 7(B), the light dots LD are formed at the odd-numbered pixel positions P1 and P3.

The reason that the dot-forming pulse W1 is generated for every other pixel is that setting the main scan rate (scanning speed) to a higher level in order to accelerate printing makes it physically difficult to eject the inks at every pixel position. More specifically, the ink ejection frequency depends not only on the frequency of the drive signal but also on the mechanical natural frequency of the nozzle section. Consequently, the frequency of pixels on a main scan line during main scanning exceeds the upper limit of the ink ejection frequency when the main scan rate is set to a high level in order to accelerate printing. It is impossible in this case to eject the ink onto every pixel, so the ink is ejected onto every other pixel. Alternatively, it is possible to set the main scan rate to a relatively low level and to generate dot-forming pulses W1 for all the pixel positions on the same main scan line.

FIGS. 7(C) and 7(D) depict the formation of dark dots DD and the waveform of the second common drive signal COMb for forming the dark dots DD. The second common drive signal COMb is also a signal that generates a single dot-forming pulse W1 for every other pixel. Since the dark dots DD are formed at the even-numbered pixel positions P2 and P4, the pulse W1 is also generated with a timing the corresponds to the even-numbered pixel positions P2 and P4.

It can be seen in FIG. 7(E) that the dark ink drops for the light dots LD shown in FIG. 7(B) and the light ink drops for the dark dots DD shown in FIG. 7(D) are ejected on the same main scan line during the same main scan. In the present specification, one main scan may also be referred to as a "pass." The six nozzle arrays for the six types of ink are disposed at the same positions in the sub-scanning direction SS, as shown in FIG. 4. Consequently, six types of ink drops containing cyan or magenta ink drops (light and dark) are ejected on the same main scan line during a single main scan.

Only one main scan is performed on a single main scan line for ejecting the small ink drops for light dots LD. The light dots LD are therefore formable at every other pixel. The same applies to dark dots DD. These two pixels will be referred to hereinbelow as a "pixel pair" or "pixel block." In the examples shown in FIGS. 7(A)–7(E), two pixel positions P1, P2 constitute a pixel pair, as do two pixel positions P3, P4. The light dots LD are formed at one of the pixel positions of a pixel pair, and the dark dots DD are formed at the other pixel position.

Figures 8A, 8B:
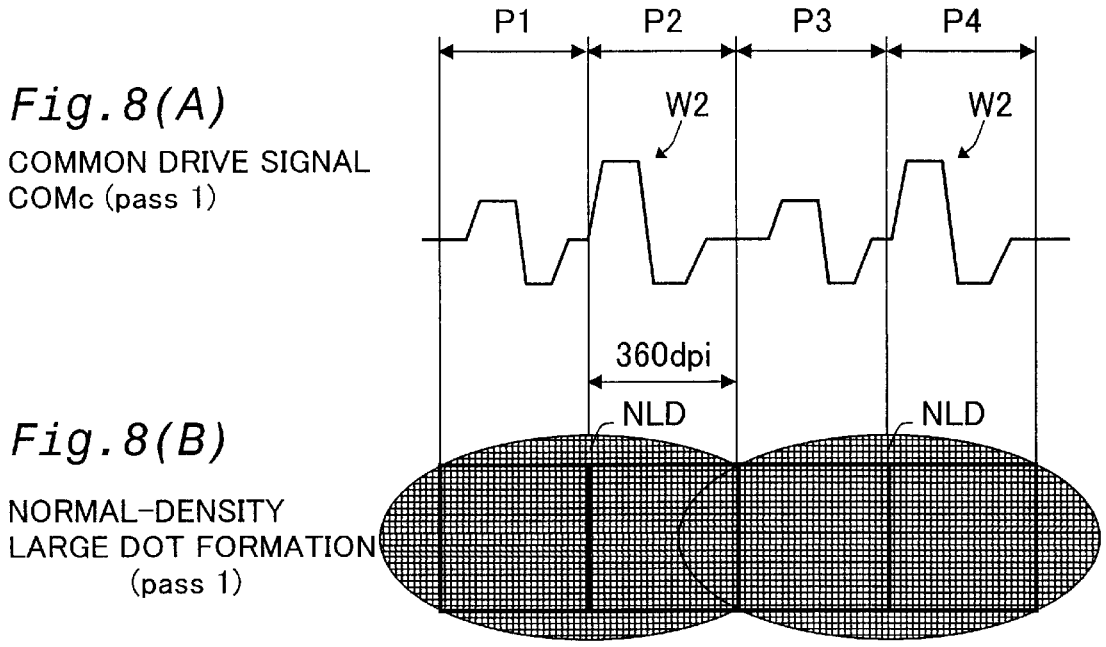
FIGS. 8(A) and 8(B) illustrate dot formation and the waveforms of the drive signals used to eject yellow and black inks in accordance with the high-speed print mode of the first embodiment.

FIGS. 8(A) and 8(B) depict the formation of normal-density large dots NLD and the waveform of the third common drive signal COMc for forming the normal-density large dots NLD for yellow and black inks. As used herein, the term "normal-density large dots NLD" refers to large dots formed by an ink whose relative colorant density is 1 (FIG. 5).

The third common drive signal COMc is a signal for generating a single dot-forming pulse W2 at a rate of one pixel for every two pixels. A normal-density large dot NLD is formed such that it occupies the surface area of two pixels, as shown in FIG. 8(B). Consequently, the amount of ink per pixel to form a normal-density large dot NLD is set substantially equal to the amount of ink per pixel for the light dots LD or dark dots DD shown in FIG. 7(E).

Figure 9A:
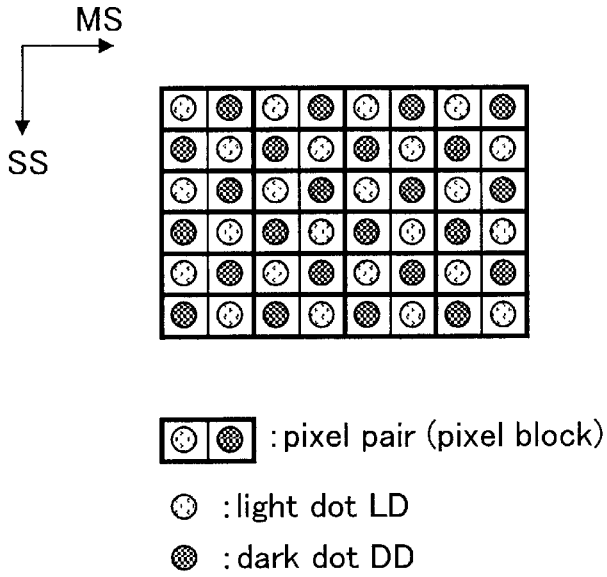
FIGS. 9(A) and 9(B) illustrate the arrangement of dots in a solid image obtained in accordance with the first embodiment.
Figure 9B:
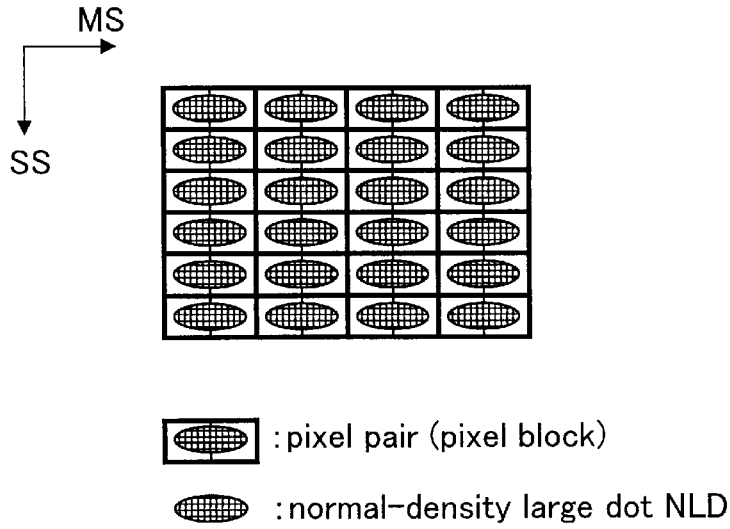

A solid image is reproduced when an ink is ejected at each pixel pair over a wide range, as shown in FIGS. 7(E) and 8(B). FIGS. 9(A) and 9(B) are diagrams illustrating arrangement examples for the dots that constitute such solid images. For the sake of convenience, each pixel in FIG. 9 is drawn smaller than those of FIGS. 7(B), 7(E), 9(B), and the dots are drawn smaller than the pixels.

It can be seen in FIG. 9(A) that the light dots LDs and dark dots DD are alternately formed in the main scanning direction MS and sub-scanning direction SS in a solid image. For the sake of convenience, spaces are left between the light dots LD and dark dots DD in FIG. 9(A), but in practice the ink spreads out and closes these spaces.

A dot arrangement such as the one shown in FIG. 9(A) can be obtained by arranging pixel pairs in reverse order on adjacent main scan lines. Using such an arrangement has the benefit of making it easier to reproduce uniform solid images. Another benefit is that when uniformly printed images are reproduced, the image quality can commonly be improved because the light dots and dark dots can be arranged substantially uniformly without any imbalance.

Figure 10A:
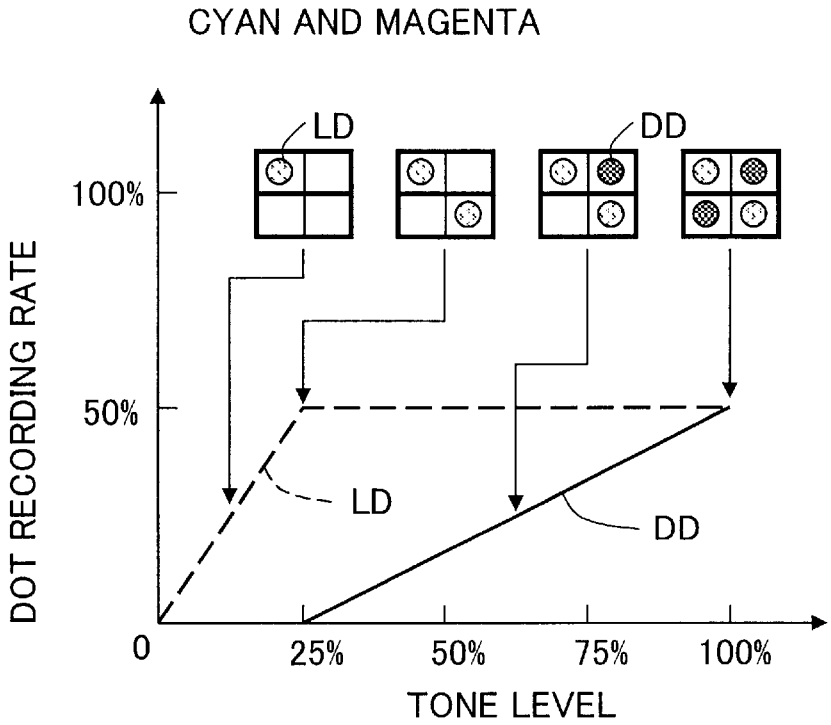
FIGS. 10(A) and 10(B) show the relation between the tone level and the dot recording rate according to the first embodiment.
Figure 10B:
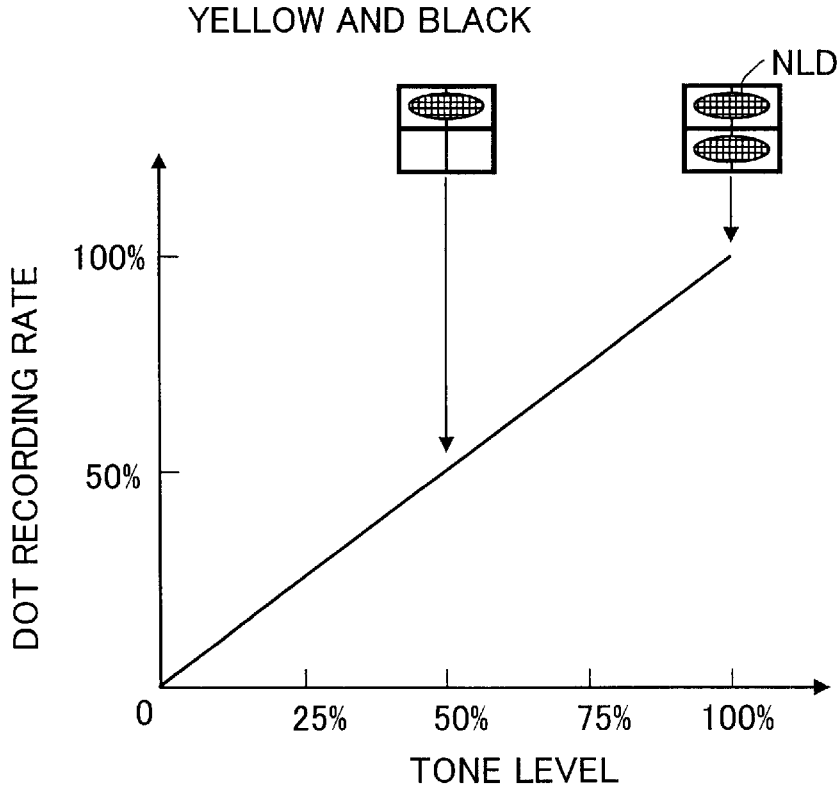

FIGS. 10(A) and 10(B) show the relation between the tone level (gradation level) and the dot recording rate according to the first embodiment. FIG. 10(A) is a graph related to cyan and magenta, and FIG. 10(B) is a graph related to yellow and black. The tone level of an image is plotted on the horizontal axis, and the dot recording rate is plotted on the vertical axis. As used herein, the term "dot recording rate" refers to the rate at which dots are recorded within the confines of an area. The multi-tone data created for each ink by the color conversion module 98 (FIG. 1) of the printer driver 96 are designed to express this dot recording rate.

In the case of cyan and magenta, light dots LD alone are recorded in a tone range from 0% to 25%, and its dot recording rate increases rectilinearly. Specifically, light dots LD are formed at a rate of one out of every four pixels when the tone level is 12.5%, and the light dots LD are formed at a rate of one out of every two pixels when the tone level is 25%. When the tone level exceeds 25%, the dot recording rate of dark dots DD increases rectilinearly while the recording ratio of the light dots LD remains constant at 50%. The recording ratios of both the light dots LD and dark dots DD reaches 50% when the tone level is 100% (that is, when solid images are formed).

In the case of yellow and black, the dot recording rate of the normal-density large dots NLD increases rectilinearly from 0% to 100% throughout the entire tone range from 0% to 100%. Gray tones can be also reproduced using a composite black reproduced with inks of C, M, and Y, instead of using black ink.

The characteristics shown in FIGS. 10(A) and 10(B) are stored in a color correction lookup table LUT (FIG. 1).

Figure 11:
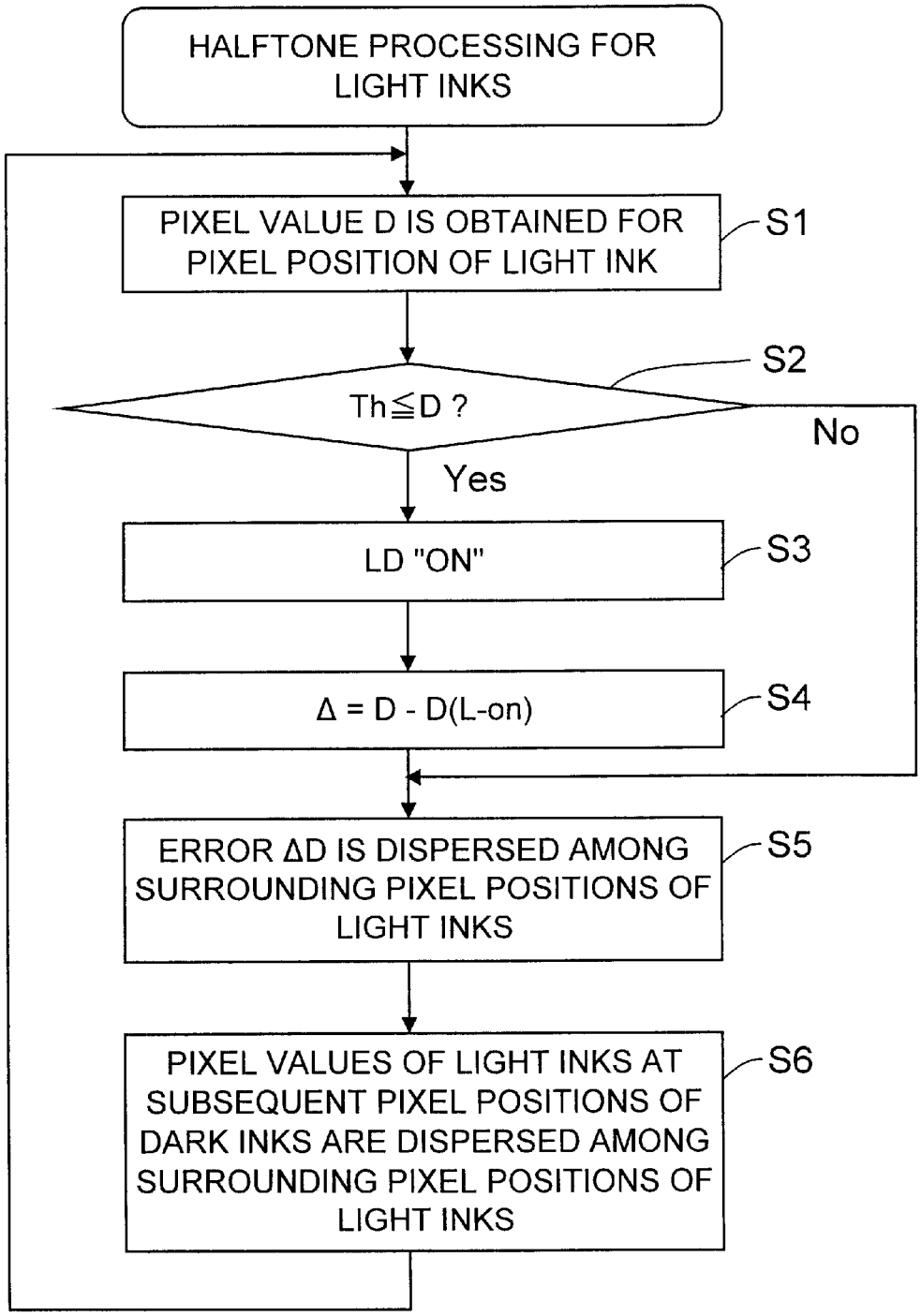
FIG. 11 is a flowchart depicting a halftone processing procedure for a light ink.

FIG. 11 is a flowchart depicting a halftone processing procedure based on error dispersion. This procedure is executed by the halftone module 99 (FIG. 1) for the light cyan and magenta inks.

In step S1, a pixel value D is obtained for the pixel positions of the light ink. The pixel value D may, for example, have 8 bits and range from 0 to 255. In step S2, the pixel value D is compared with a threshold Th for light dots. If the pixel value D is greater than the threshold Th, the formation of the light dots LD at this pixel position is set to "on" in step S3. In step S4, error ΔD is calculated by subtracting from the pixel value D the tone level D(L-on) corresponding to the on-state of the light dots LD. If less than the threshold Th, the pixel value D is directly used as the error ΔD. In step S5, the error ΔD is dispersed among the surrounding light-ink pixel positions. In step S6, the pixel value of the light ink at the next dark-ink pixel position is dispersed among the surrounding light-ink pixel positions.

Step S6 is performed because the color conversion module 98 (FIG. 1) determines the tone levels of light inks at all the pixel positions without distinguishing whether the pixel positions are for light or dark inks. Dark inks are also subjected to halftone processing by substantially the same procedure as in FIG. 11.

In the case of yellow and black inks, the resolution conversion module 97 converts the results to a resolution that corresponds to pixel pairs, and the halftone module 99 performs regular halftone processing for each pixel pair.

The procedure shown in FIG. 11 is premised on the fact that the resolution conversion module 97 converted available results to a resolution that corresponded to the pixel shown in FIG. 9(A) for cyan and magenta inks. Alternatively, the resolution conversion module 97 can convert the results to a resolution that corresponds to the cyan and magenta pixel pairs. In this case, the step S6 shown in FIG. 11 will be omitted.

Thus, the first embodiment is such that one of the pixels in a pixel pair is assigned to a light ink and the other pixel is assigned to the dark inks for the cyan and magenta, making it possible to completely eject the cyan and magenta inks at all the pixel position on a main scan line during a single main scan by ejecting the inks from each nozzle for every other pixel. With yellow and black, ink ejection can be completed for all the pixel positions on a main scan line during a single main scan by forming large dots whose size corresponds to the size of pixel pairs. As a result, color images can be rapidly printed.

It is known that cyan and magenta have a greater effect on the image quality of color images than do yellow and black. An advantage of the first embodiment is that because color images are printed using cyan and magenta dots that are smaller than yellow or black dots, printing can be accomplished faster without unduly reducing the quality of the images. In particular, light cyan or magenta dots LD are used in large amounts, and other dots are hardly used at all in bright image areas (highlight areas). The first embodiment allows images having comparatively high quality to be printed at a high printing speed even when such highlight areas are reproduced.

C. Second Embodiment

Figure 12:
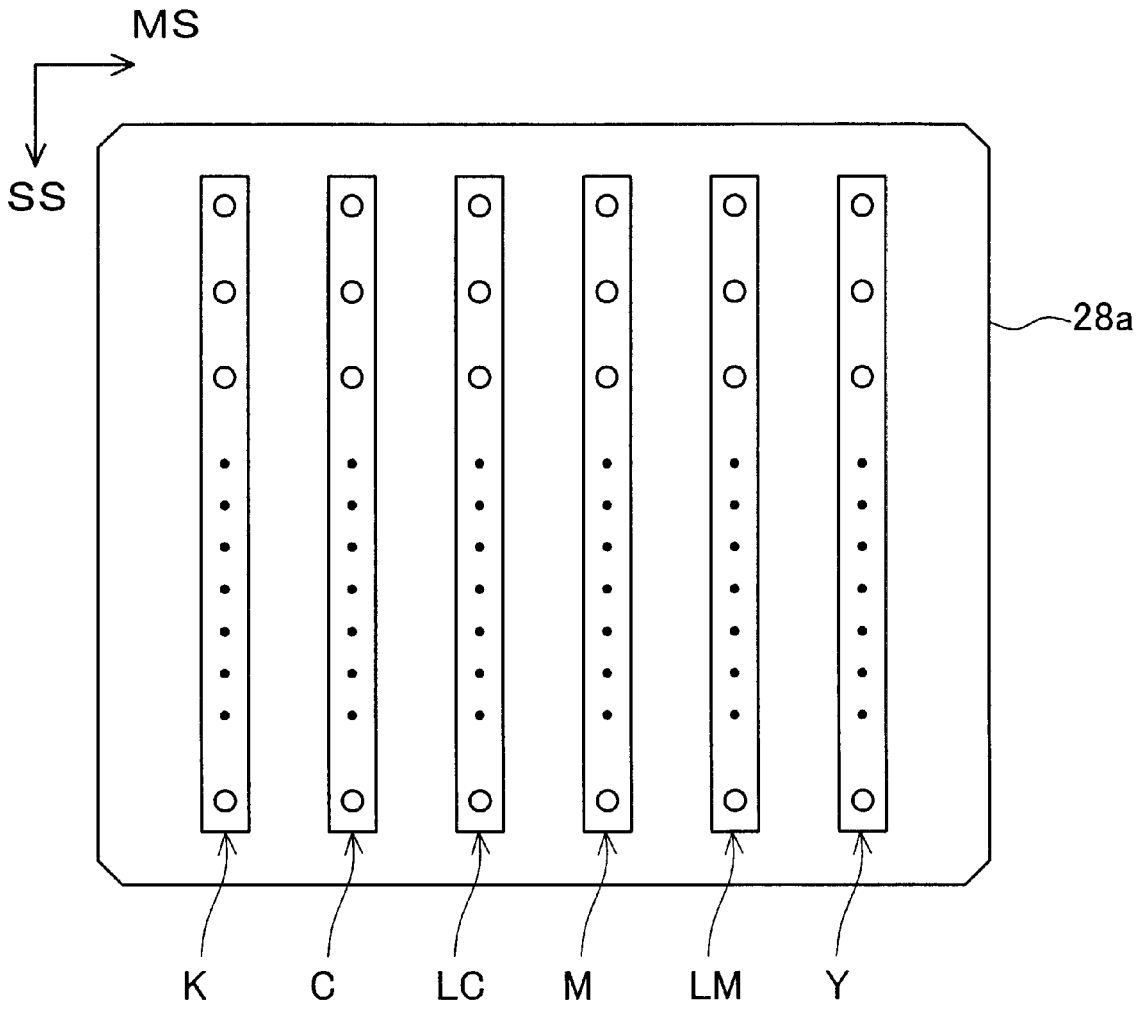
FIG. 12 is a diagram depicting the arrangement of nozzles in accordance with a second embodiment.

FIG. 12 is a diagram depicting a nozzle arrangement for a print head 28*a* used in accordance with a second embodiment. In the second embodiment, nozzle arrays for a standard cyan ink C and standard magenta ink M are used instead of the nozzle arrays (FIG. 4) for the dark cyan ink DC and dark magenta ink DM used in the first embodiment.

FIG. 13 is a diagram depicting the relative colorant densities of inks used in accordance with the second embodiment. The standard cyan ink C and standard magenta ink M have a relative colorant density of 1, which is the same as the relative density of the yellow ink and black ink. In addition, the relative colorant density of the light cyan ink LC and light magenta ink LM is 0.25.

The second embodiment is different from the above-described first embodiment in that the normal-density inks whose relative density is the same as that of the yellow ink and black ink are used as the maximum-density cyan and magenta inks. Cyan and magenta dots will therefore be formed in a different manner, as described below.

FIGS. 14(A)–14(E) are diagrams illustrating dot formation and the waveforms of the drive signals used to eject cyan and magenta inks in accordance with the second embodiment. These diagrams correspond to the diagrams shown in FIGS. 7(A)–7(E) for the first embodiment.

Figures 14A, 14B, 14C, 14D, 14E:
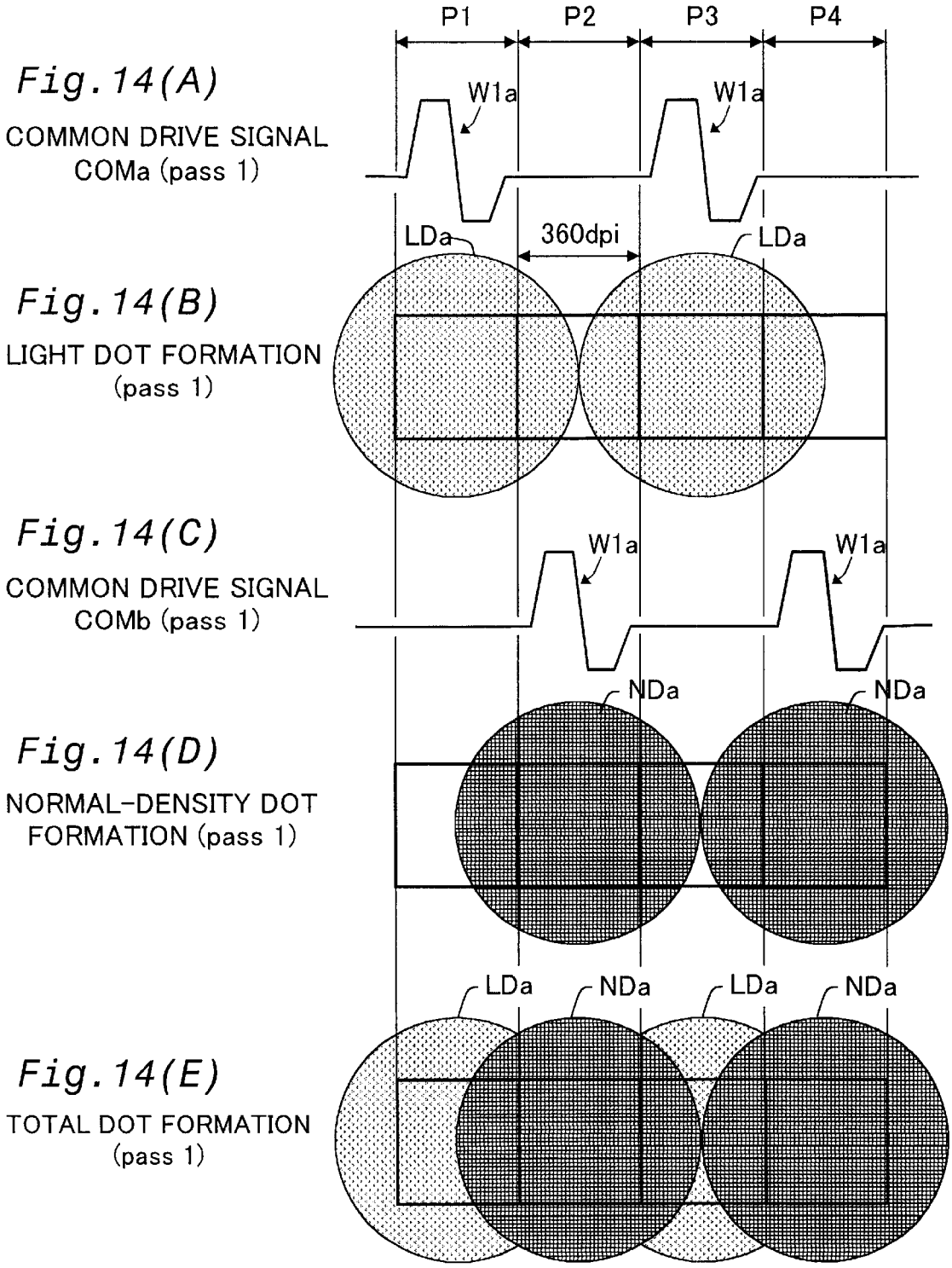
FIGS. 14(A)–14(E) illustrate dot formation and the waveforms of the drive signals used to eject cyan and magenta inks in accordance with the high-speed print mode of the second embodiment.

A comparison of FIGS. 7(E) and 14(E) demonstrates that the light dots LDa or normal-density large dots NDa of the second embodiment are larger than the light dots LD or dark dots DD of the first embodiment. Specifically, the amount of ink needed for the light dots LDa or normal-density large dots NDa of the second embodiment is about 1.6 times the amount of ink needed for the light dots LD or dark dots DD of the first embodiment. This ink amount is set such that the mean amount of colorant per pixel is the same as that for the yellow or black ink. The yellow or black dots are the same as those shown in FIG. 8(B), and will therefore be omitted from the description.

Similar to the first embodiment, the second embodiment has the advantage of being able to provide faster printing without unduly lowering the quality of color images.

D. Third Embodiment

Figure 15:
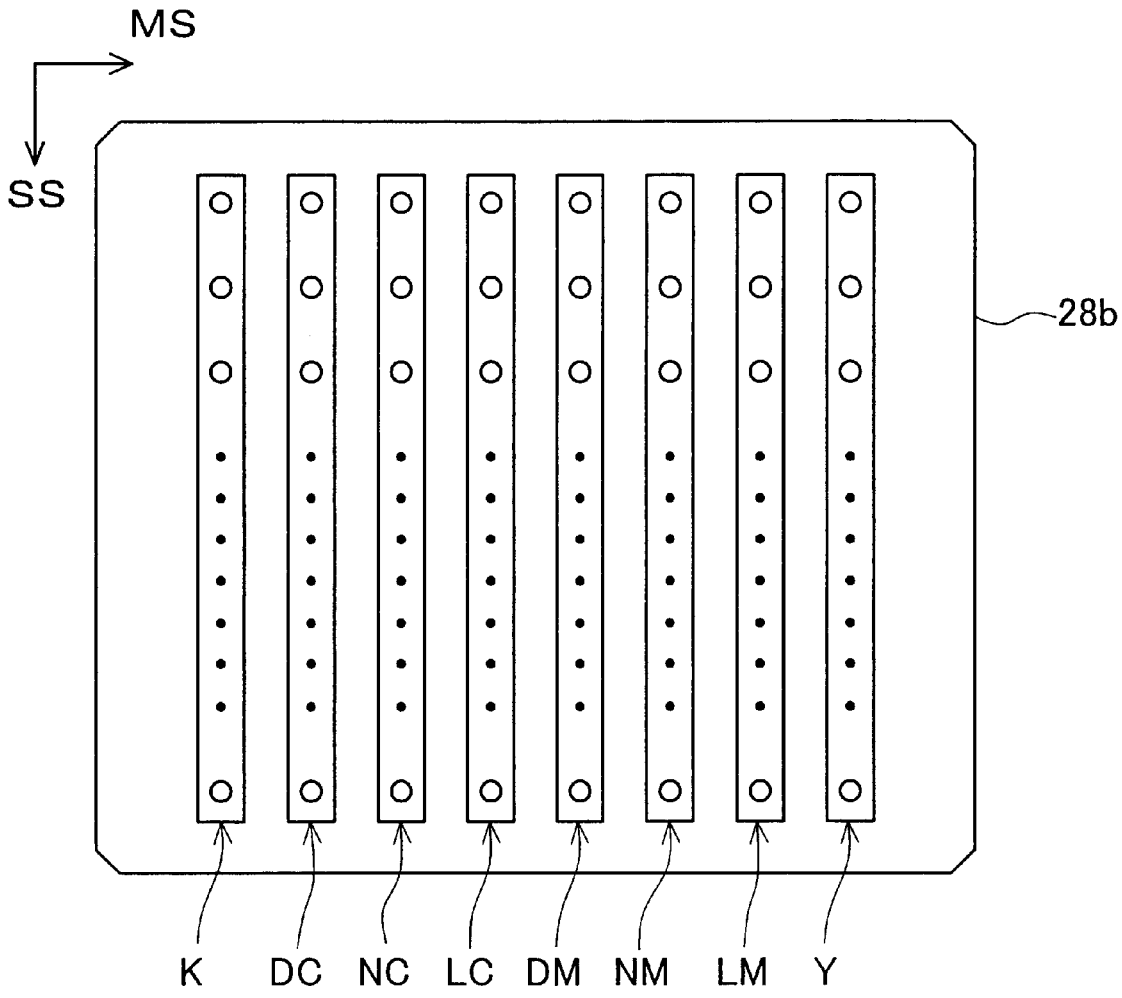
FIG. 15 is a diagram depicting the arrangement of nozzles in accordance with a third embodiment.
Figures 17A, 17B, 17C, 17D, 17E, 17F, 17G:
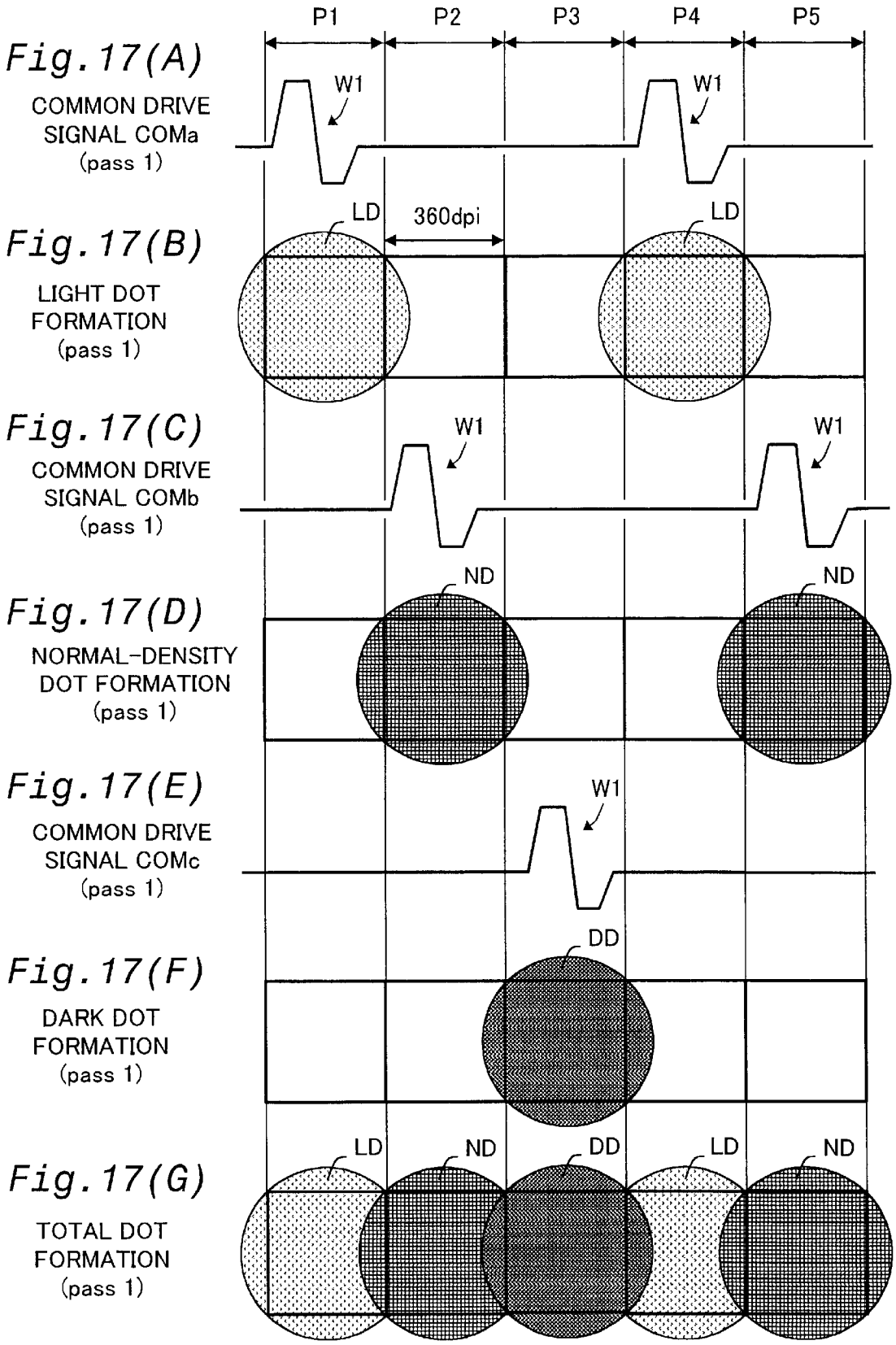
FIGS. 17(A)–17(G) illustrate dot formation and the waveforms of the drive signals used to eject cyan and magenta inks in accordance with the high-speed print mode of the third embodiment.

FIG. 15 is a diagram depicting a nozzle arrangement for a print head 28*b* used in accordance with a third embodiment. In the third embodiment, nozzle arrays for a dark ink DC, normal-density ink NC, and light ink LC are provided for cyan. The same applies to magenta.

FIG. 16 shows the relative colorant densities of the inks used in the third embodiment. The densities of the dark cyan ink DC and light cyan ink LC are 1.5 and 0.5, respectively, which is the same as those in the first embodiment shown in FIG. 5. In addition, the standard cyan ink C has a relative colorant density of 1. The same applies to magenta.

FIGS. 17(A)–17(G) are diagrams illustrating dot formation and the waveforms of the drive signals used to eject cyan and magenta inks in the high-speed print mode of the third embodiment. According to the third embodiment, light dots LD, normal-density dots ND, and dark dots DD are respectively formed at a rate of one pixel for every three pixels on a single main scan line. Specifically, the light dots LD are formed at the first, fourth, and corresponding subsequent pixel positions. In addition, the normal-density dots ND are formed at the second, fifth, and corresponding subsequent pixel positions, and the dark dots DD are formed at the third, sixth, and corresponding subsequent positions.

Figure 18A:
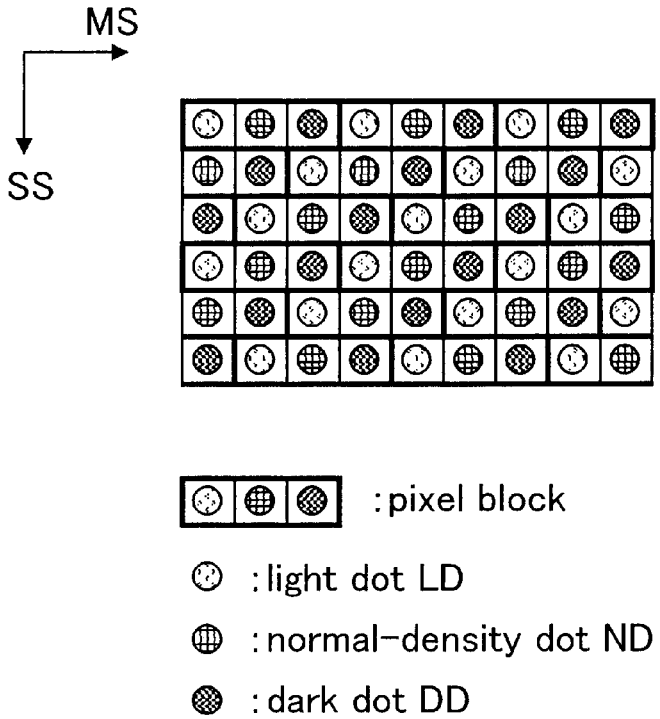
FIGS. 18(A) and 18(B) illustrate the arrangement of dark and light dots in accordance with the third embodiment.
Figure 18B:
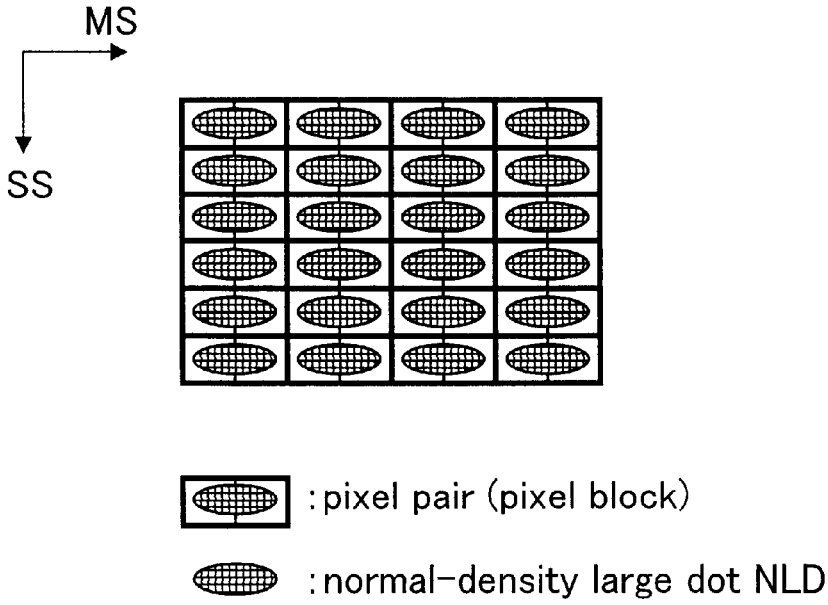

FIGS. 18(A) and 18(B) show the arrangement of dots constituting a solid image according to the third embodiment. It can be seen in FIG. 18(A) that three successive pixels on a main scan line constitute a single pixel block for cyan and magenta inks. A light dot LD, a normal-density dot ND, and a dark dot DD are formed inside each pixel block. The pixel blocks of the mutually adjacent main scan lines are arranged at mutually different positions. When uniformly printed images are reproduced using such an arrangement, the image quality can commonly be improved because the light dots and dark dots can be arranged substantially uniformly without any imbalance.

It can be seen in FIG. 18(B) that a single large dot is formed with the yellow or black ink in each pixel pair in the same manner as in the first embodiment. Specifically, the pixel blocks for cyan and magenta inks and the pixel blocks for yellow and black inks differ in size. It is thus possible to reproduce uniform images in each case. Grey tones may also be reproduced using composite black instead of black ink.

Figure 19:
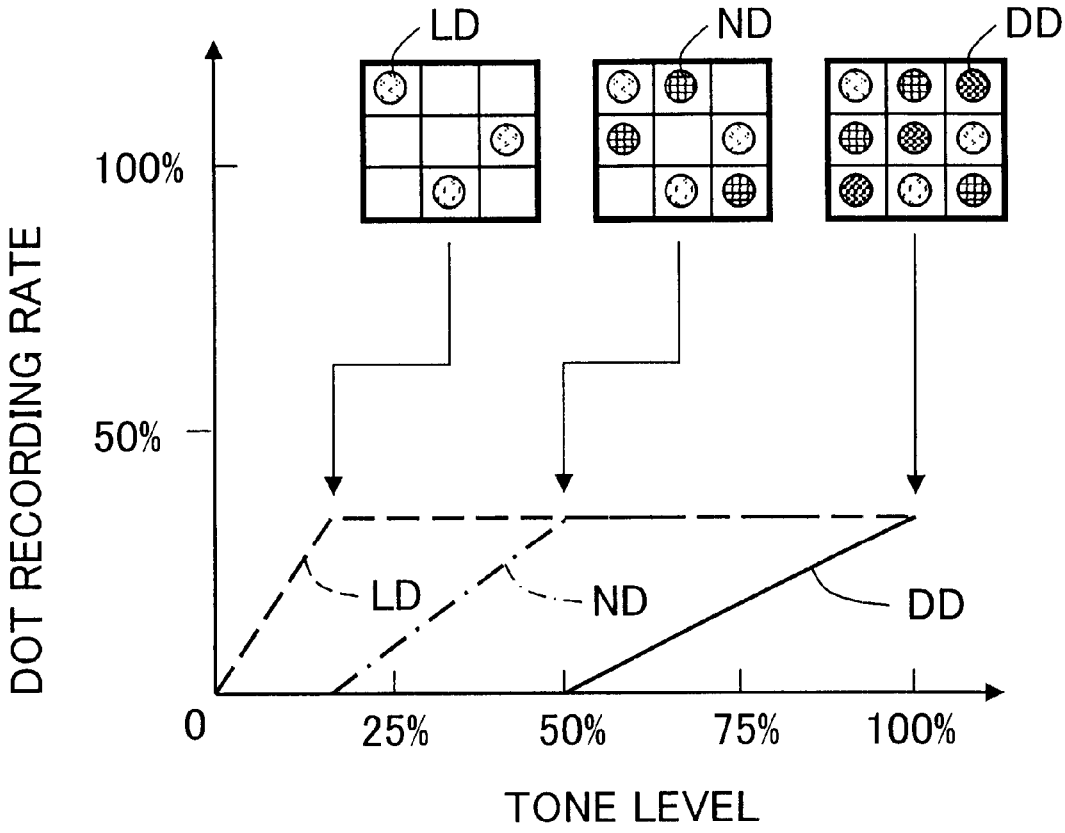
FIG. 19 is a graph of the relation between the tone level and the dot recording rate according to the third embodiment.

FIG. 19 is a graph of the relation between the tone level and the dot recording rate for the cyan and magenta inks in the third embodiment. The relation for the yellow and black is the same as in the first embodiment (FIG. 10(A)), and will therefore be omitted from the description.

In the case of cyan and magenta, light dots LD alone are recorded in a tone range from 0% to about 17%, and the dot recording rate increases rectilinearly. Specifically, light dots LD are formed at a rate of one out of every three pixels when the tone level is about 17%. When the tone level ranges from about 17% to 50%, the dot recording rate of normal-density dots ND increases rectilinearly all the way to 50% while the recording rate of the light dots LD remains constant at about 33%. When the tone level ranges from 50% to 100%, the dot recording rate of the dark dots DD increases rectilinearly all the way to about 33% while the recording rates of both the light dots LD and the normal-density dots ND remain constant at about 33%.

Similar to the first and second embodiments, the third embodiment has the advantage of being able to provide faster printing without unduly lowering the quality of color images. In addition, smoother halftones can be reproduced because three types of different density inks are used for the cyan and magenta.

E. Modified Examples

E1. Modified Example 1

Although the above embodiments are described with reference to cases in which each ink forms dots of constant size, it is also possible to vary the dot size of some or all the inks. The dot size can be varied by a procedure in which the common drive signal generating circuit 110 (FIG. 6) generates common drive signals whose waveforms allow a plurality of different ejection amounts to be implemented, and these signals are then shaped by the drive signal shaping circuit 120.

E2. Modified Example 2

Although the above embodiments were described with reference to cases in which pixel blocks were formed from successive pixels in the main scanning direction, it is also possible to adopt an arrangement in which the pixel blocks are composed of successive pixels in the sub-scanning direction. Alternatively, it is possible to use pixel blocks having a specific repeatable shape such as a rectangular shape. In addition, the above embodiment are described with reference to cases in which a single pixel block is composed of two or three pixels, but it is also possible to adopt an arrangement in which each pixel block comprises four or more pixels. Each pixel block commonly comprises N pixels where N is an integer of 2 or greater, and printable areas in which images are printed are divided into such pixel blocks. When this is done, the N pixels in each pixel block are correlated on a one-on-one basis with the ejection positions of N types of identically hued inks.

E3. Modified Example 3

Although the above embodiments are described with reference to cases in which a plurality of different density inks are used for the cyan and magenta, the present invention can also be adapted to a situation in which a plurality of different density inks are used for at least one hue. Images obtained using primarily the ink of this hue can be printed more rapidly in this case as well.

E4. Modified Example 4

Although the above embodiments are described with reference to cases in which large dots are formed from yellow and black inks across two pixels, it is also possible to adopt an arrangement in which the dots are formed in each pixel. In this case as well, printing can be speeded up during the printing of images composed substantially exclusively of cyan and magenta dots by adopting an arrangement in which the ejection positions of different density cyan and magenta inks are distributed across the pixel blocks.

It is also possible to adopt an arrangement in which M types of identically hued inks are used at least for one ink selected from yellow and black, print areas are divided into pixel blocks composed of M pixels where M is an integer of 2 or greater, and the M pixels in each pixel block are correlated on a one-on-one basis with the ejection positions of the M types of identically hued inks. The integer M may be the same as or different from the number N of identically hued cyan or magenta inks. Adopting this arrangement also makes it possible to accelerate printing without unduly lowering the image quality of one or more hues selected from yellow and black for which M types of identically hued inks can be used.

To achieve an even higher printing speed, each nozzle array should preferably be actuated such that the formation of dots by multiple types of inks on each main scan line is completed in a single main scan, as described above with reference to the embodiments.

E5. Modified Example 5

Although the above embodiments are described with reference to cases in which a plurality of nozzle arrays are disposed at the same positions in the sub-scanning direction, this arrangement can be substituted with an arrangement in which the nozzle arrays are out of alignment with the sub-scanning direction. In addition, the above embodiments are described with reference to cases in which each nozzle array consists of the same number of nozzles, but it is also possible to adopt an arrangement in which different nozzle arrays are composed of different numbers of nozzles. In a preferred embodiment, the number of nozzles in the black nozzle array may be greater than the number of nozzles in other nozzle arrays in order to accelerate monochromatic printing.

E6. Modified Example 6

According to the first or third embodiment, the mean colorant density of the identically hued cyan or magenta inks is set substantially equal to the colorant density of the yellow or black ink, and the amount of ink needed to create each pixel during solid image reproduction is set substantially equal to the amount of each of the inks C, M, Y, K. According to the second embodiment, the arrangement in which the colorant density of the densest ink (normal-density ink) selected from the identically hued cyan or magenta inks is set substantially equal to the colorant density of the yellow or black ink can be replaced with an arrangement in which the amount of ink needed to create each cyan or magenta pixel is set above that for the yellow or black ink. These three embodiments demonstrate that the ejection amounts of identically hued inks (cyan and magenta) are set such that their solid images can reproduce gray colors when a solid yellow image is superposed on them. Adopting this arrangement allows solid images characterized by an improved gray balance to be obtained with the three hues C, M, Y.

E7. Modified Example 7

The present invention can also be adapted to a drum-type printer. In a drum-type printer, the rotation direction of the drum is the main scanning direction, and the travel direction of the carriage is the sub-scanning direction. This would entail adapting the present invention not only to a so-called ink-jet printer but also to any other common printing device for printing images on the surface of a printing medium with the aid of a print head having a plurality of nozzles. Examples of such printing devices include facsimile machines and copying machines.

E8. Modified Example 8

Some of the hardware circuitry in the embodiment described above can be performed by software, or, conversely, some of the software functions can be performed by hardware. For example, some of the functions of the control circuit 40 (FIG. 2) can be performed by the host computer 90.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing device for printing images on a printing medium during main scanning, comprising:

a print head having a plurality of nozzle arrays for ejecting multiple types of ink, and a plurality of ejection drive elements for causing ink drops to be ejected from nozzles of the plurality of nozzle arrays;

a main scan drive unit for performing main scans by causing the printing medium and/or the print head to move;

a sub-scan drive unit for performing sub-scans by causing the printing medium and/or the print head to move;

a head drive unit for sending drive signals to the ejection drive elements in accordance with given print signals; and a control unit for controlling each of the above units, wherein the print head comprises N nozzle arrays for ejecting N types of identically hued inks, respectively, for at least for one hue, N being an integer of 2 or greater, the identically hued inks having substantially a same hue but mutually different densities;

the control unit has a specific print mode in which tone reproduction using the N types of identically hued inks is performed such that (i) a print area is divided into pixel blocks each consisting of N pixels, and (ii) the N pixels in each pixel block are assigned to ejection positions of the N types of identically hued inks, respectively.

2. A printing device according to claim 1, wherein the print head has N nozzle arrays for ejecting the N types of identically hued inks for cyan and magenta;

the control unit operates in the specific print mode such that (iii) tone reproduction for cyan and magenta is performed using the N types of identically hued inks in each pixel block for each of the cyan and magenta; and (iv) tone reproduction for at least one of yellow and gray is performed by forming large dots of corresponding ink across a plurality of pixels.

3. A printing device according to claim 1, wherein the head drive unit drives the plurality of nozzle arrays such that formation of dots for each of the multiple types of inks on each main scan line is completed in a single main scan rather than in two or more main scans.

4. A printing device according to claim 1, wherein the N pixels constituting each pixel block are arranged at mutually different positions on adjacent main scan lines.

5. A printing device according to claim 1, wherein the print head has N nozzle arrays for ejecting the N types of identically hued inks for cyan and magenta; and maximum ejection amounts of the N types of identically hued inks for cyan and magenta are set such that solid cyan image and solid magenta image will reproduce a gray color when a solid yellow image is superposed on the solid cyan and magenta images.

6. A printing device according to claim 1, wherein a maximum total ejection amount of the N types of identically hued inks per pixel for each of cyan and magenta used for reproduction of solid cyan and magenta images is set substantially equal to a maximum amount of the yellow ink per pixel used for reproduction of a solid yellow image; and an average colorant density of the N types of identically hued inks for each of cyan and magenta is set substantially equal to a colorant density of a yellow ink used for the reproduction of a solid yellow image.

7. A printing device according to claim 1, wherein a colorant density of the densest ink of the N types of identically hued inks for each of cyan and magenta is set substantially equal to a colorant density of a yellow ink used for reproduction of a solid yellow image; and a maximum total amount of the N types of identically hued inks per pixel for each of cyan and magenta used for reproduction of solid cyan and magenta images is greater than a maximum amount of the yellow ink per pixel used for the reproduction of a solid yellow image.

8. A printing method for printing images on a printing medium during main scanning, comprising the steps of:

(a) providing a print head having N nozzle arrays for ejecting N types of identically hued inks for at least for one hue, N being an integer of 2 or greater, the identically hued inks having substantially a same hue but mutually different densities; and (b) printing an image using multiple types of inks including the N types of identically hued inks such that (i) a print area is divided into pixel blocks each consisting of N pixels, and (ii) the N pixels in each pixel block are assigned to ejection positions of the N types of identically hued inks, respectively.

9. A printing method according to claim 8, wherein the print head has N nozzle arrays for ejecting the N types of identically hued inks for cyan and magenta;

wherein the step (b) is performed such that (iii) tone reproduction for cyan and magenta is performed using the N types of identically hued inks in each pixel block for each of the cyan and magenta; and (iv) tone reproduction for at least one of yellow and gray is performed by forming large dots of corresponding ink across a plurality of pixels.

10. A printing method according to claim 8, wherein dot formation for the multiple types of inks on each main scan line is completed in a single main scan rather than in two or more main scans.

11. A printing method according to claim 8, wherein the N pixels constituting each pixel block are arranged at mutually different positions on adjacent main scan lines.

12. A printing method according to claim 8, wherein the print head has N nozzle arrays for ejecting the N types of identically hued inks for cyan and magenta; and maximum ejection amounts of the N types of identically hued inks for cyan and magenta are set such that solid cyan image and solid magenta image will reproduce a gray color when a solid yellow image is superposed on the solid cyan and magenta images.

13. A printing method according to claim 8, wherein a maximum total ejection amount of the N types of identically hued inks per pixel for each of cyan and magenta used for reproduction of solid cyan and magenta images is set substantially equal to a maximum amount of the yellow ink per pixel used for reproduction of a solid yellow image; and an average colorant density of the N types of identically hued inks for each of cyan and magenta is set substantially equal to a colorant density of a yellow ink used for the reproduction of a solid yellow image.

14. A printing method according to claim 8, wherein a colorant density of the densest ink of the N types of identically hued inks for each of cyan and magenta is set substantially equal to a colorant density of a yellow ink used for reproduction of a solid yellow image; and a maximum total amount of the N types of identically hued inks per pixel for each of cyan and magenta used for reproduction of solid cyan and magenta images is greater than a maximum amount of the yellow ink per pixel used for the reproduction of a solid yellow image.

* * * * *